United States Patent [19]

Hadley

[11] 4,022,320

[45] May 10, 1977

[54] RECORD STORAGE APPARATUS

[76] Inventor: Seth Paul Hadley, 643 Agnes Ave., Brielle, N.J. 08730

[22] Filed: Oct. 29, 1975

[21] Appl. No.: 626,716

[52] U.S. Cl. ..... 206/310; 206/493; 206/523; 312/12

[51] Int. Cl.[2] ..... B65D 85/02; B65D 85/36

[58] Field of Search ..... 206/303, 309, 310, 311, 206/312, 313, 493, 523; 312/8, 9, 10, 12

[56] References Cited

UNITED STATES PATENTS

| | | | |
|---|---|---|---|
| 1,320,958 | 11/1919 | Albrecht et al. | 312/10 |
| 1,464,932 | 8/1923 | Hand | 312/10 |
| 1,585,846 | 5/1926 | Frisbie | 206/310 |
| 2,500,773 | 3/1950 | Robins | 206/311 |
| 2,663,416 | 12/1953 | Hirsch | 206/310 |
| 2,866,541 | 12/1958 | Ravis | 206/313 |
| 3,053,424 | 9/1962 | Reinhard | 206/303 |
| 3,317,038 | 5/1967 | Bade et al. | 206/313 |
| 3,609,722 | 9/1971 | Zenzefilis | 206/303 |

FOREIGN PATENTS OR APPLICATIONS

| | | | |
|---|---|---|---|
| 940,214 | 12/1948 | France | 206/311 |
| 294,696 | 7/1928 | United Kingdom | 206/310 |
| 21,009 | 9/1907 | United Kingdom | 206/313 |
| 779,108 | 7/1957 | United Kingdom | 206/313 |
| 364,928 | 4/1931 | United Kingdom | 312/12 |

*Primary Examiner*—William Price
*Assistant Examiner*—Bruce H. Bernstein
*Attorney, Agent, or Firm*—Charles I. Brodsky

[57] ABSTRACT

A phonograph record, video picture disc, or the like, is held in "sandwich" fashion between first and second layers of pressure absorbing, resilient material, and also held in substantially fixed position on a planar surface by means of a spindle forming a part thereof and passing through coaxial apertures in the layers in passing through the central aperture of the record or disc. The planar surface is selected of material sufficiently rigid to support the record or disc and resilient layers, but sufficiently thin to be inserted within grooves of guide inserts adapted for securement within a cabinet, to serve as trays or shelves for the the storage of such records or picture discs, either vertically or horizontally.

9 Claims, 6 Drawing Figures

Fig. 1.
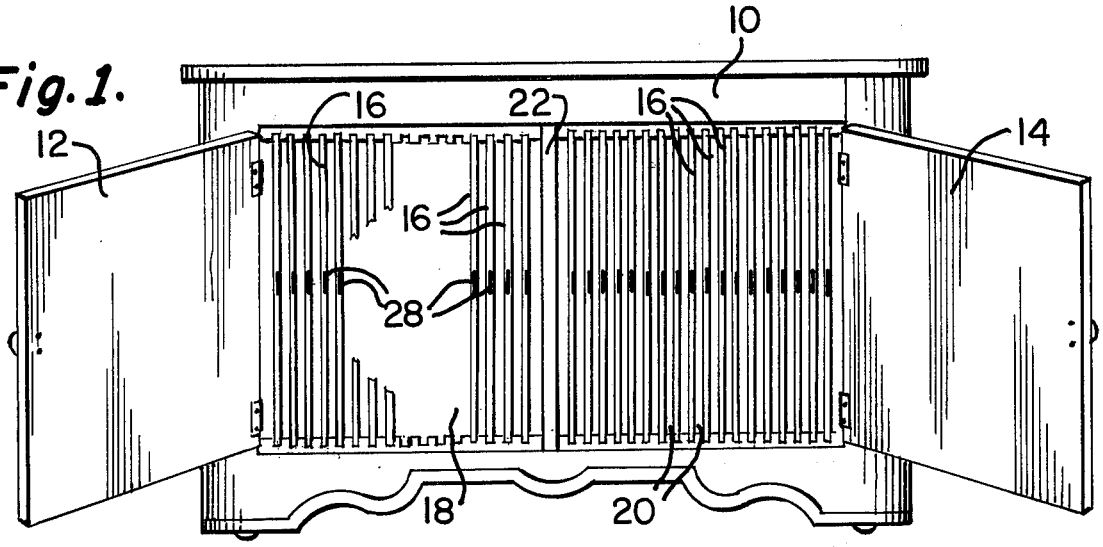
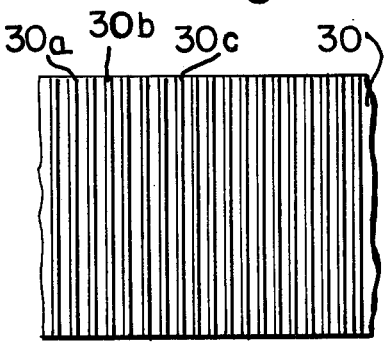
Fig. 2.
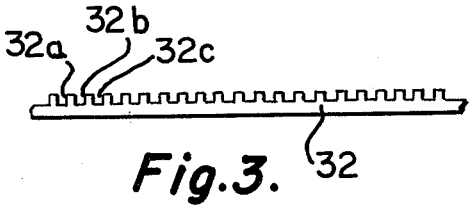
Fig. 3.
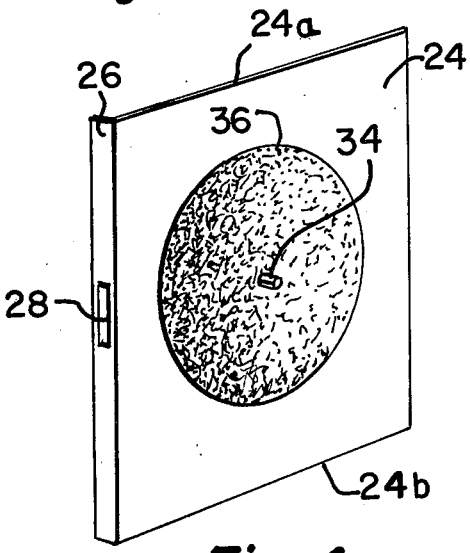
Fig. 4.
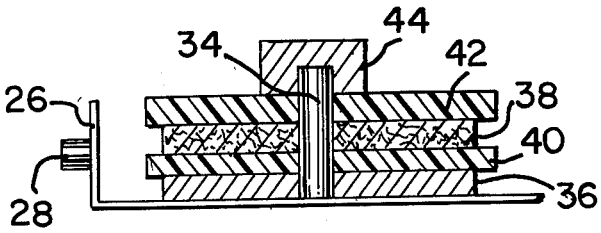
Fig. 5.
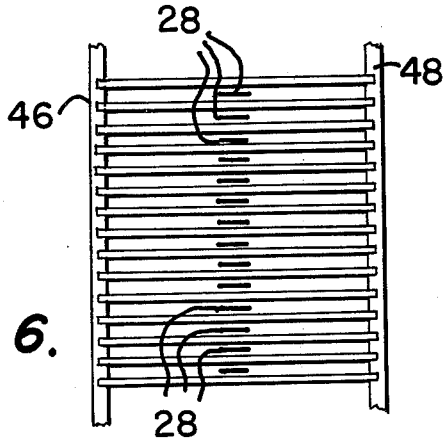
Fig. 6.

RECORD STORAGE APPARATUS

FIELD OF THE INVENTION

This invention relates to record storage apparatus and, more particularly, to a cabinet for use in the storage of phonograph records, video picture discs, or the like. As will be seen hereinafter, the record storage apparatus is easily adaptable to rectangular, square, circular, or other configuration cabinet design, and to vertical or horizontal storage of records or discs, as well.

SUMMARY OF THE INVENTION

One record storage apparatus embodying the invention will be seen to incorporate a planar surface having a centralized spindle as a part thereof. Overlying the planar surface, and through an aperture of which the spindle passes, is a first layer of pressure absorbing, resilient material, of disc configuration and of a diameter slightly less than the diameter of a phonograph record or video picture disc which is inserted also in overlying relationship therewith, centered about the spindle which passes its central aperture. A second pressure absorbing, resilient layer construction is placed in further overlying relationship with respect to the record or disc — also or disc configuration, but in this case, of a diameter slightly greater than that of the record or disc. With such relationships established, the second layer disc construction can be supported at its circumferential edges and lifted away from the "sandwiched" phonograph record or picture disc, without touching the latter. Furthermore, with such upper layer removed, the record or disc can then similarly be removed by supporting its own circumferential edges, without touching its playing surfaces or the first, layer disc which lies beneath.

In accordance with a preferred embodiment of the invention, a record storage cabinet is provided with upper and lower inwardly facing, guide inserts, each of which incorporates a plurality of horizontally displaced grooves or slots in aligned relationship. The record or disc carrying surface can be oriented vertically to fit within oppositely facing grooves in the formation of a record storage cabinet wherein all records or discs are stored vertically. In alternative designs, the record or disc carrying tray could be oriented horizontally, to, in this case, fit within inwardly and oppositely facing slots displaced vertically on a pair of guide inserts secured to the upright side numbers of the cabinet in storing the records or discs horizontally. In either case, the planar tray can be provided with an angular front portion, of a width approximating the spacings between adjacent tray placements, and along the lengths thereof, to act as a protective dust barrier and to provide a surface upon which a record or disc catalogue identification — e.g. the slot number or name of the phonograph record inserted — could be affixed.

As will be appreciated by those skilled in the art, this method of storage of individual records or video picture discs is preferable to presently employed arrangements wherein the record or disc is kept within a cardboard, plastic or paper jacket. Specifically, with this arragement, there will be a reduced tendency for the scratching of the surface of the record or disc by the jacket, as well as a simplification in the manner by which the record or disc can be supported for play and return, thereby lessening the possibility of imparting oil, dirt or grease from grasping with the fingers or hands into the information carrying grooves. While such handling has heretofore proved objectionable to an extent with respect to phonograph records, the problem is substantially heightened for the case of video picture discs, where any scratching of the surface could very well upset video synchronization and result in the tearing of the reproduced image. With the relative diameter differences between the pressure distributing layer constructions and the "sandwiched" record or disc of the invention, on the other hand, only the edges of the record or disc need be supported to remove the record or disc for play and in the return of it when reproduction is completed. Prior art problems, therefore, of reinserting the record within a jacket of only slightly greater dimension is reduced, as is the possible rubbing of the inside of the jacket against the record or disc surfaces which can result in subsequent audio and/or video distortion.

BRIEF DESCRIPTION OF THE DRAWING

These and other features of the invention will be more clearly understood from a consideration of the following description taken in connection with the accompanying drawing in which:

FIG. 1 shows a record storage cabinet constructed in accordance with the principles of the present invention;

FIG. 2 shows a plan view of a guide insert for receiving the record or disc storage surface of the invention;

FIG. 3 shows a side elevational view of the guide insert of FIG. 2;

FIG. 4 is a perspective view of the record or disc storage surface;

FIG. 5 shows a side elevational view of a section of the surface of FIG. 4, with the record or disc sandwiched between the upper and lower surface layer constructions; and FIG. 6 illustrates a manner of storing records or discs in an alternative embodiment of the invention.

DETAILED DESCRIPTION OF THE DRAWINGS

In FIG. 1, a record storage cabinet 10 of antique colonial design is shown for purposes of illustration, although cabinets of traditional, mediterranean and modern design are equally suitable to the principles of the invention. The doors of the cabinet 12, 14 are shown open, to illustrate the vertical storage of record or disc carrying trays 16 in left and right compartments 18, 20, separated by a divider 22. In one construction of the invention, polystyrene trays 24, of 13 inch by 13 inch planar surface (FIG. 4), are used for the trays 16, being selected of some ⅛ inch thickness and with a rightangled front portion 26 of some ⅝ inch width along the length of the tray 24. In constructing the cabinet 10 of FIG. 1 with these dimensions, the inside dimensions of the compartment 18, 20 could be approximately 14 inches high, 14 inches deep and 20 inches across to accommodate some 25 record storage trays in each compartment. A longitudinal handle 28 extending a distance of ¼ inch is located along each front portion of the tray, which is selected sufficiently rigid to support a phonograph record or video picture disc.

As is shown in FIGS. 1 and 2, the individual trays 16 are inserted in the cabinet 10 such that their upper and lower surfaces **24*a* and 24*b* fit within grooves or slots running along the length of a guide insert 30. This insert 30 is secured in inwardly facing orientation at the upper and lower confines of the compartments 18, 20 such that the individual grooves or slots 30***a*, 30*b*, 30*c*, etc. are in axial alignment to permit substantially 90°, vertical insertion of the record trays 24 between upper and lower guide inserts. A side elevational view of the guide insert 32 at the lower confine of the compartment 18 is shown in FIG. 3, with the end views of the grooves identified by the reference notations "32*a*", "32*b*", "32*c*" etc.

As shown in FIG. 4 each tray or planar surface 24 is formed with a centrally situated spindle 34, of a ¼ inch diameter and ½ inch length, for example. Surrounding the spindle 34, in substantially coaxial alignment with it, is a first pressure absorbing or resilient layer disc 36, approximately ⅛ inch thick and of a diameter slightly less than that of the typical phonograph record or video picure disc — illustratively, 11½ inch in the case of a 12 inch diameter phonograph record. Such layer disc 40 may be of a sponge-like or felt material, glued to, or otherwise affixed on the spindle side of the surface 24. When it is desired to store a record or picture disc after play that record or disc is fitted atop the support layer 36 by pressing it against it in orientation such that the spindle 34 also passes through the aperture of the record or disc, as shown in the section of FIG. 5. A second pressure absorbing or resilient layer disc 38 is then fitted atop the record or disc 40, also in coaxial orientation so that the spindle 34 passes through an apertured hole centrally situated within it. As illustrated, the second layer disc 38 is backed with a less resilient or rigid material, such as a plastic 42 to form a compound structure in which the upper layer in contact with the record or disc 40 is substantially of the same general diameter as the lower layer 36 but wherein the plastic backing 42 is of a greater diameter, preferably at least equal to that of the record or disc 40, itself. To hold the combination firmly in place, a wing nut 44, of neoprene material, for example, could be fastened over the spindle 34 which, in such case, might be self threading. When selected larger than the diamter of the spindle 34, the wing nut 44 can, when tightened, serve to impart an inwards pressure against the plastic disc backing 42 so as to hold the record 40 in place, sandwiched between the layers 36, 38. The tray 24 can then be grasped by its outer edges, and fitted within the grooves 30*a*, 30*b*, 30*c*, etc., and pushed into the compartment 18, 20 as the case may be to be stored therein. When it is desired to play the record or picture disc within a particular groove location, the planar surface tray construction can be removed from its compartment housing merely by grasping the handle 28 in the angled portion 26 and pulling outwards. The wing nut 44 is then unfastened, the upper layer disc construction is removed by an upwards lifting with the fingers or palm of the hand along the circumferential edge of the backing 42, and the record or disc 40 can be removed in similar manner.

In one example of the present invention, the portion 26 extending along the planar surface 24 is selected sufficiently wide so that record catalogue information can be inserted on a label and pasted on its side, identifying the tray either by record name (e.g. "New World Symphony") or as groove 1, in accordance with a predetermined index. Furthermore, the width of the portion 26 is also dimensioned substantially similar to the spacing between adjacent grooves 30*a*, 30*b*, 30*c*, etc. so as to form a physically blocking barrier against the entry of dust in those instances where the cabinet doors 12, 14 are held open. Such dimensioning further insures a minimum of dust particles from reaching the information grooves of the record or disc, to further supplement the protection afforded by the surface contacting layers 36, 38. A plastic backing 42 of diameter at least equal to that of the record 40 and an upper layer 38 of only slightly less diameter are selected as a means of applying sufficient pressure to the entire surface of the recording medium so as to lessen the possibility of record bowing, drooping or warpage. This is further facilitated by the preferred embodiment of the invention, wherein gravity serves to cause the record medium to hang substantially vertically in the cabinet illustrated.

This relative dimensioning and presence of pressure backing is particularly important in those instances where the tray surface 24 is oriented horizontally, as in FIG. 6, rather than in the preferred vertical alignment of FIG. 1. In the FIG. 6 configuration, the guide inserts 46, 48 will be seen to be arranged vertically, for securement along the left and right inside portions, respectively of the compartments 18, 20, from front to back wherein the guide grooves run horizontally along the depth of the cabinet. The shelf handles 28 are than disposed vertically, one below the other, rather than disposed horizontally, one alongside the other, as in the vertical alignment of FIG. 1. Without such "sandwich" construction, the uneven weight distribution along the record or disc could cause it to droop or sag.

While there have been described what are considered to be preferred embodiments of the present invention, it will be readily apparent that modifications may be made by those skilled in the art without departing from the scope of the teachings herein of providing a record storage apparatus in which a phonograph record or video picture disc is held sandwiched between a pair of contact layers for support against warpage and bowing, and wherein the record or disc is of diameter larger than that of one layer construction but smaller than that of the other layer construction. For example, whereas the invention has been described in the context of a storage cabinet of rectangular dimensioning, it will be obvious that the invention will be equally appropriate for square cabinet designs, for circular configurations, or for more intricate constructions for that matter, simply by the applicable placement and orientation of the guide inserts employed. It will be equally obvious that added storage space can be provided the cabinet of the drawing by removing the compartment divider 22, or by making the cabinet of two tier or "double decker" contruction—in such latter instance, a horizontal shelf divider carrying an upwards facing guide insert will be employed on the top surface of the divider whereas a downwards facing guide insert will be used on the bottom surface. In either arrangement, an additional storage space could be provided to house the album jackets, so as to make them available for reading while the phonograph record or video picture disc is being played. Moreover, added ease of removing the plastic backed construction from protecting the record, disc, or the like can be had merely by increasing the diameter of the construction, as compared to that of the record or disc. For such reason, the scope of the present invention should be read in light of theclaims appended hereto.

I claim:

1. Apparatus for use in storing a phonograph record, video picture disc or the like comprising:

a support member;

a first layer of pressure absorbing material secured to said support member;

means adapted to cooperate with said first layer to hold said record, said disc or the like in fixed, overlying relationship with said layer;

a second layer of pressure absorbing material adapted to cooperate with said holding means in overlying said record, said disc or the like, also in fixed relationship; and a backing member secured to a side of said second layer of pressure absorbing material remote from the record, disc or the like held in overlying relationship thereby;

with said first and second layers of pressure absorbing material being each of a dimension less than that of the playing surface of said record or disc measured in a plane parallel thereto, and with said backing member being of a dimension at least as great as that of said playing surface measured in a plane parallel thereto;

whereby said backing member and said second layer can be easily lifted away from said record, said disc or the like without substantially increasing the surface contact therewith and whereby said record, said disc or the like can be easily lifted away from said first layer, also without substantially increasing the surface contact with said record, said disc or the like.

2. The apparatus of claim 1 wherein said first layer of pressure absorbing material is of a disc configuration having a diameter slightly less than the diameter of said phonograph record, video picture disc or the like.

3. The apparatus of claim 2 wherein said second layer of pressure absorbing material is also of a disc configuration having a diameter slightly less than the diameter of said phonograph record, video picture disc or the like.

4. The apparatus of claim 3 wherein each of said first layer, said second layer, said backing member and said phonograph record, video picture disc or the like include coaxially alinged apertures and wherein said holding means includes a spindle positioned to pass through each of said apertures in the storage of said record, disc or the like.

5. The apparatus of claim 4 wherein said backing member is of less resilient material than said second layer of pressure absorbing material and wherein there is also included means bearing against said backing member for compressing said second layer of pressure absorbing material towards said playing surface.

6. The apparatus of claim 5 wherein said support member is of generally planar surface having an angled front surface portion sufficiently wide to accept an index designation of the record, disc or the like stored thereon.

7. The apparatus of claim 6 wherein said angled front surface portion includes a handle for ease in inserting said support member into a record or disc storage cabinet and in removing said support member therefrom.

8. The apparatus of claim 7 wherein said angled front surface portion is of a width approximating the spacing between adjacent support members stored in a record or disc storage cabinet.

9. The apparatus of claim 8 wherein said second layer of pressure absorbing material is of a diameter substantially equal to that of said first layer of pressure absorbing material and wherein said backing member is of a diameter slightly greater than that of said phonograph record, video picture disc or the like.

* * * * *